US011754095B2

(12) United States Patent
Li et al.

(10) Patent No.: US 11,754,095 B2
(45) Date of Patent: Sep. 12, 2023

(54) PUMP FRONT CHAMBER AUTOMATIC COMPENSATION DEVICE FOR IMPROVING CLOSED IMPELLER BACKFLOW

(71) Applicant: JIANGSU UNIVERSITY, Zhenjiang (CN)

(72) Inventors: Wei Li, Zhenjiang (CN); Lei Wang, Zhenjiang (CN); Ling Zhou, Zhenjiang (CN); Yong Zhu, Zhenjiang (CN); Hao Chang, Zhenjiang (CN); Qi Chen, Zhenjiang (CN); Pu Wu, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 52 days.

(21) Appl. No.: 17/623,271

(22) PCT Filed: Jul. 22, 2021

(86) PCT No.: PCT/CN2021/107858
§ 371 (c)(1),
(2) Date: Dec. 28, 2021

(87) PCT Pub. No.: WO2021/254531
PCT Pub. Date: Dec. 23, 2021

(65) Prior Publication Data

US 2022/0356888 A1 Nov. 10, 2022

(30) Foreign Application Priority Data

Jun. 16, 2020 (CN) ..... 202010546250.0

(51) Int. Cl.
*F04D 29/66* (2006.01)
*F04D 15/00* (2006.01)
(Continued)

(52) U.S. Cl.
CPC ..... *F04D 29/669* (2013.01); *F04D 15/0027* (2013.01); *F04D 29/026* (2013.01); *F04D 29/426* (2013.01)

(58) Field of Classification Search
CPC .. F04D 15/0027; F04D 29/026; F04D 29/162; F04D 29/167; F04D 29/426; F04D 29/669
(Continued)

(56) References Cited

U.S. PATENT DOCUMENTS 6,471,468 B1 10/2002 Hartmann
2007/0274820 A1* 11/2007 Lindskog ..... F04D 7/045 415/55.1
(Continued)

FOREIGN PATENT DOCUMENTS

CN 1871437 A 11/2006
CN 201412395 Y 2/2010
(Continued)

*Primary Examiner* — Charles G Freay
*Assistant Examiner* — Chirag Jariwala
(74) *Attorney, Agent, or Firm* — Bayramoglu Law Offices LLC

(57) ABSTRACT

A pump front chamber automatic compensation device for improving closed impeller backflow is provided. The automatic compensation device is mounted on the inner wall surface of the pump body front chamber, extending from the inner wall surface of the pump body front chamber to the impeller front cover plate, stopping the flow of fluid from the impeller outlet to the pump front chamber. The automatic compensation device includes a spacer plate and a compensation feedback device. One end of the spacer plate extends into the pump front chamber, and the other end is connected to the automatic compensation assembly, through which the length of the spacer extension is automatically compensated. The pump front chamber automatic compensation device can prevent the fluid flowing out of the impeller outlet from
(Continued)

entering the front chamber of the centrifugal pump, thus improving the operating efficiency and stability of the centrifugal pump.

12 Claims, 3 Drawing Sheets

(51) Int. Cl.
*F04D 29/02* (2006.01)
*F04D 29/42* (2006.01)

(58) Field of Classification Search
USPC ..... 415/172.1, 173.2–173.3, 174.1–174.3
See application file for complete search history.

(56) References Cited

U.S. PATENT DOCUMENTS

| | | | | |
|---|---|---|---|---|
| 2008/0279681 | A1* | 11/2008 | Eguchi | F04D 29/444 415/206 |
| 2018/0030992 | A1* | 2/2018 | Masutani | F04D 17/125 |

FOREIGN PATENT DOCUMENTS

| | | | | | |
|---|---|---|---|---|---|
| CN | 102536835 | A | | 7/2012 | |
| CN | 105201903 | A | | 12/2015 | |
| CN | 106015016 | A | * | 10/2016 | F04D 7/02 |
| CN | 106015016 | A | | 10/2016 | |
| CN | 205639079 | U | | 10/2016 | |
| CN | 208057427 | U | | 11/2018 | |
| CN | 111852955 | A | | 10/2020 | |

* cited by examiner

PUMP FRONT CHAMBER AUTOMATIC COMPENSATION DEVICE FOR IMPROVING CLOSED IMPELLER BACKFLOW

CROSS REFERENCE TO THE RELATED APPLICATIONS

This application is the national phase entry of International Application No. PCT/CN2021/107858, filed on Jul. 22, 2021, which is based upon and claims priority to Chinese Patent Application No. 202010546250.0, filed on Jun. 16, 2020, the entire contents of which are incorporated herein by reference.

TECHNICAL FIELD

The invention belongs to the technical field of fluid mechanics. It relates in particular to an automatic compensation device for the front chamber of a pump to improve the return flow of a closed impeller.

BACKGROUND

Centrifugal pumps are widely used in the military, nuclear power, water conservancy, and agricultural irrigation. Due to the existence of a gap between the pump body and the impeller cover of the centrifugal pump, not only volume loss is generated, but also changes the internal flow structure of the pump. Mainly because the rotating parts rotating influences the front chamber flow, the flow characteristics are quite complex, the complex flow generated in the front chamber such as vortex and reflux cause a reduction in pump efficiency. The front chamber water body rotates at high speed, creating resistance to the impeller rotating parts, causing the pump to operate unstably. Existing research has found that changing the distance between the pump body wall and the impeller to adjust the gap structure on the pressure and velocity distribution of the fluid in the front chamber of the pump has a greater impact, and the gap is reduced, the volume loss is reduced, the pump operating efficiency increased.

To improve the operational efficiency and stability of centrifugal pumps and minimize the gap between the pump body and the front cover plate, the structural design can be used to stop as little fluid at the impeller outlet as possible from flowing back into the front chamber. After searching, the patent (CN205639079U) is mainly used to improve the flow and reduce losses in the front cavity by setting complementary rectangular partitions. Still, as the complementary rectangular partitions are divided into rotating and stationary parts, it is easy to produce large dynamic and static interference when the gap between them is small. Particularly when conveying media containing solid particles, the particles are prone to dry friction in the partition gap, coupled with the corrosive effect of the media, the partition wear is more serious. Therefore, there is an urgent need to invent a pump front cavity automatic compensation device to improve impeller return flow, which can effectively improve the energy loss in the pump front cavity by automatically compensating for the worn spacer, thus ensuring that the device is used can efficiently and smoothly transport the medium.

SUMMARY

The invention proposes a pump front chamber automatic compensation device for improving closed impeller backflow according to the shortcomings of the prior art, by setting the automatic compensation device on the pump body wall to prevent the fluid flowing out of the impeller outlet from entering the front chamber of the centrifugal pump, thus inhibiting the occurrence of backflow, reducing the energy loss in the front chamber of the centrifugal pump and improving the operating efficiency and stability of the centrifugal pump.

The technical solution adopted in the present invention is as follows:

A pump front chamber automatic compensation device for improving closed impeller backflow, the automatic compensation device is fixedly mounted on the inner wall surface of the pump body front chamber and extends from the inner wall surface of the pump body front chamber to the front cover plate of the impeller to stop the flow of fluid from the impeller outlet to the pump front chamber; the automatic compensation device comprises a spacer and a compensation feedback device; the spacer extends into the pump front chamber at one end and is connected to the automatic compensation assembly at the other end the length of the spacer extension is automatically compensated for by the automatic compensation assembly; the compensation feedback device controls the automatic compensation assembly.

Further, the spacer is a circular body with the pump shaft as the center of rotation, comprising a rectangular section of the spacer and a circular tip section of the spacer, the rectangular section of the spacer and circular tip section of the spacer being removably connected to facilitate the replacement of the circular tip section of the spacer.

Further, the spacer is coated on the outer surface with a nickel-chromium alloy.

Further, the automatic compensation assembly comprises an inner shaft, one end of which is connected to the push rod, the threaded shaft, and the motor shaft in that order, the other end of which is fixedly connected to the rectangular section of the spacer; the automatic compensation assembly is provided in the hydraulic chamber.

Further, the inner shaft is provided with a sleeve coaxially on the outside, the inner shaft is provided with a telescopic positioner, the telescopic positioner telescopes in the radial direction between the inner shaft and the sleeve, when the inner shaft extends out of the hydraulic chamber to achieve automatic compensation, the positioning of the extension length is achieved by the telescopic positioner.

Further, the compensation feedback device comprises a compensation detection assembly and a compensation control assembly; the compensation detection assembly comprises a distance signal transmitter, a light-sensing distance sensor, a halogen lamp, and a reflective ribbon, the reflective ribbon being provided at the circular tip section of the spacer, the distance signal transmitter, light-sensing distance sensor, and halogen lamp being fixedly mounted on the outer wall surface of the hydraulic chamber at the protruding part of the spacer.

Further, the compensation control assembly comprises a state machine, the state machine is connected to a distance signal transmitter and a micro-motor respectively, the state machine control logic is: if the distance M value returned by the light-sensing distance sensor is less than K, then the state machine issues a working command to the micro-motor to compensate by rotating the thread to push the push rod, the compensation length (push) distance is $N=K-M$, where K is the initial distance of the spacer protruding from the pump wall, M is the actual distance of the spacer protruding from the pump wall as detected by the light-sensing distance sensor.

Further, the spacers are provided multiple layers in parallel.

The beneficial effects of the present invention are as follows.

1. A pump front chamber automatic compensation device for improving closed impeller backflow designed by the present invention, the device is set between the front chamber wall between the impeller pump body and the front cover plate, the device can effectively prevent the fluid flowing out of the impeller outlet from entering the front chamber of the centrifugal pump, thus inhibiting the occurrence of backflow, reducing the energy loss in the front chamber of the centrifugal pump and improving the operating efficiency and stability of the centrifugal pump.

2, The device designed by the invention also enables automatic compensation of the protruding length by automatically adjusting the protruding length of the spacer. The spacer can automatically compensate for spacer wear, whether caused by hydraulic wear of the spacer tip or by corrosive wear of the two-phase pump medium. Fully exploit the inhibiting effect of the spacer on the backflow at the impeller outlet.

In the figure, 1. pump body, 2. pump front chamber clearance, 3. impeller, 4. first layer of spacer, 5. second layer of spacer, 6. third layer of spacer, 7. dust ring, 8. micro-motor, 9. triangular block, 10. spring, 11. waterproof ring, 12. guide ring, 13. hydraulic chamber, 14. state machine, 15. push rod, 16. distance signal transmitter, 17. light-sensing distance sensor, 18. halogen lamp, 19. reflective ribbon, 20. distance signal receiver, 21. pump shaft, 22. pin, 23. spacer circular tip section, 24. spacer rectangular section, 25. threaded shaft, 26. motor shaft, 27. automatic compensation assembly, 28. inner shaft, 29. shaft sleeve.

DETAILED DESCRIPTION OF THE EMBODIMENTS

To make the object, technical solutions and advantages of the present invention more clearly understood; the invention is described in further detail in the future in conjunction with the accompanying drawings and embodiments. It should be understood that the specific embodiments described herein are intended to explain the present invention only and are not intended to limit it.

Figure 1:
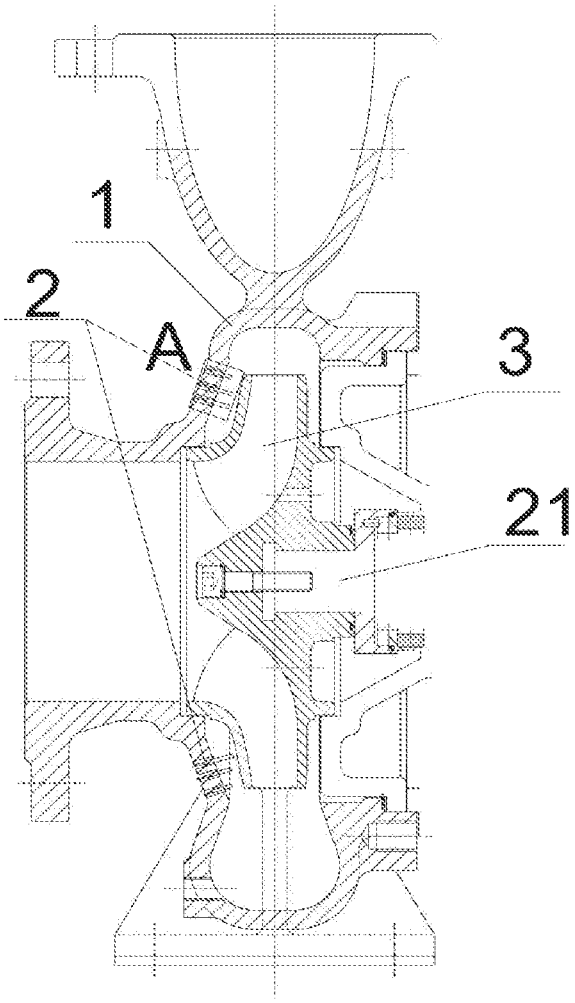
FIG. 1 shows a schematic diagram of the structure of a pump equipped with the pump front chamber automatic compensation device of the present invention.

As shown in FIG. 1, the invention is designed as a pump front chamber automatic compensation device, the design of the automatic compensation device fixed installed in the pump body front chamber inner wall surface, and from the pump body front chamber inner wall surface to the impeller front cover plate, to stop the impeller outlet flow of fluid to the pump front chamber; the automatic compensation device specifically includes a spacer plate and, compensation feedback device; the spacer plate end extends into the pump front chamber, the other end is connected to the automatic compensation assembly 27, through the automatic compensation assembly 27 to compensate the length of the pump front chamber the compensation feedback device to control the automatic compensation assembly.

Figure 2:
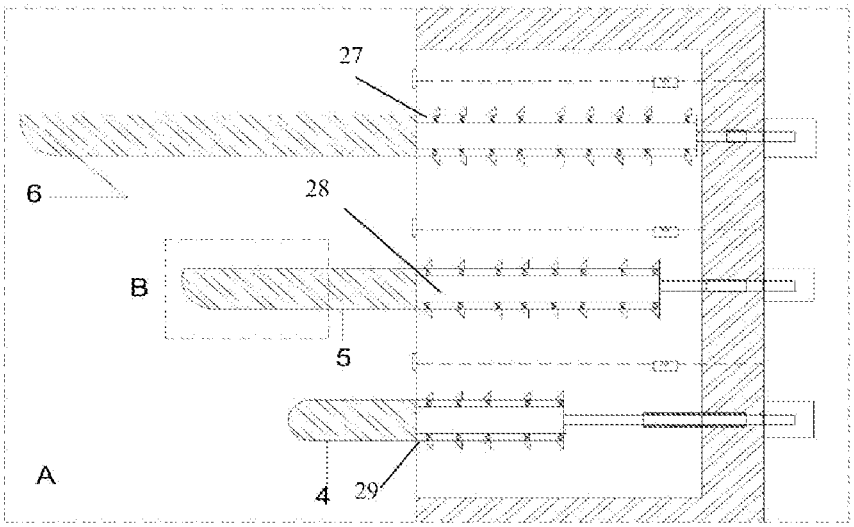
FIG. 2 shows a schematic diagram of the structure of the pump front chamber automatic compensation device of the present invention.
Figure 3:
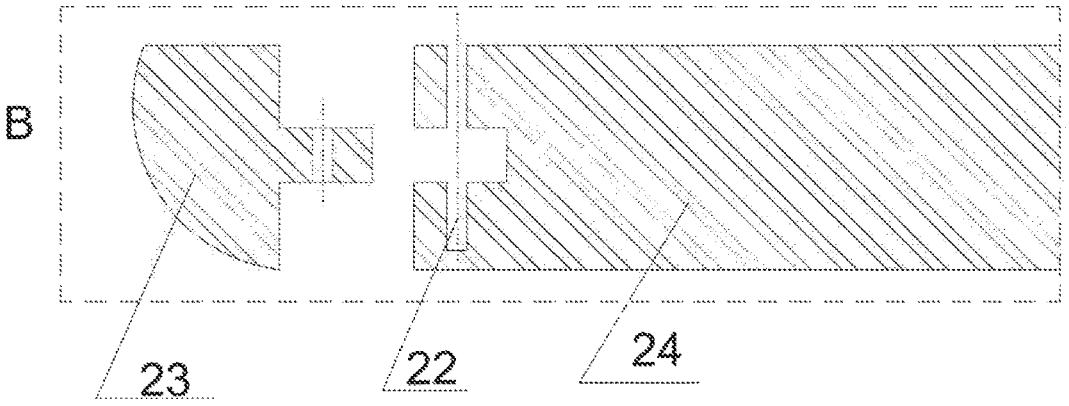
FIG. 3 shows a schematic diagram of the structure of the rounded tip section of the first spacer and the rectangular section of the spacer.
Figure 4:
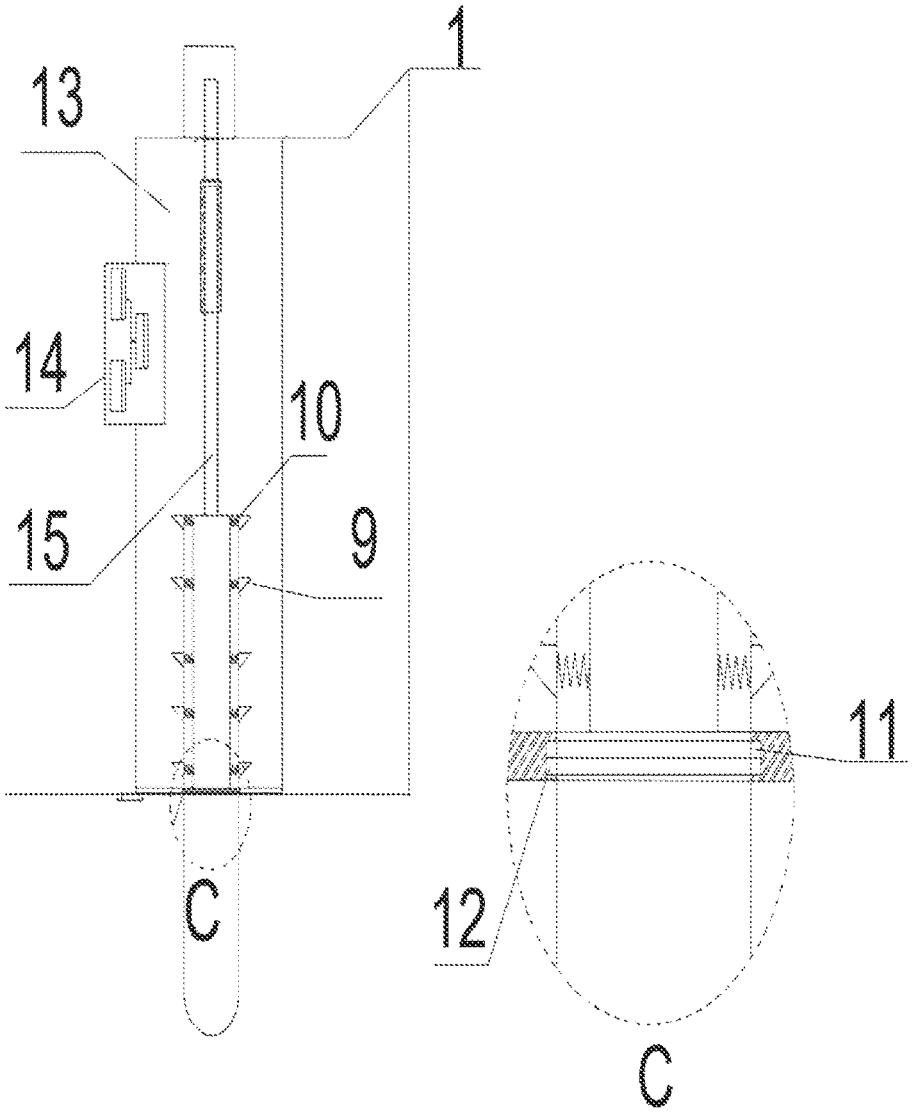
FIG. 4 shows the structure of the pump front chamber automatic compensation device and a partial enlargement at spacer outlet.
Figure 5:
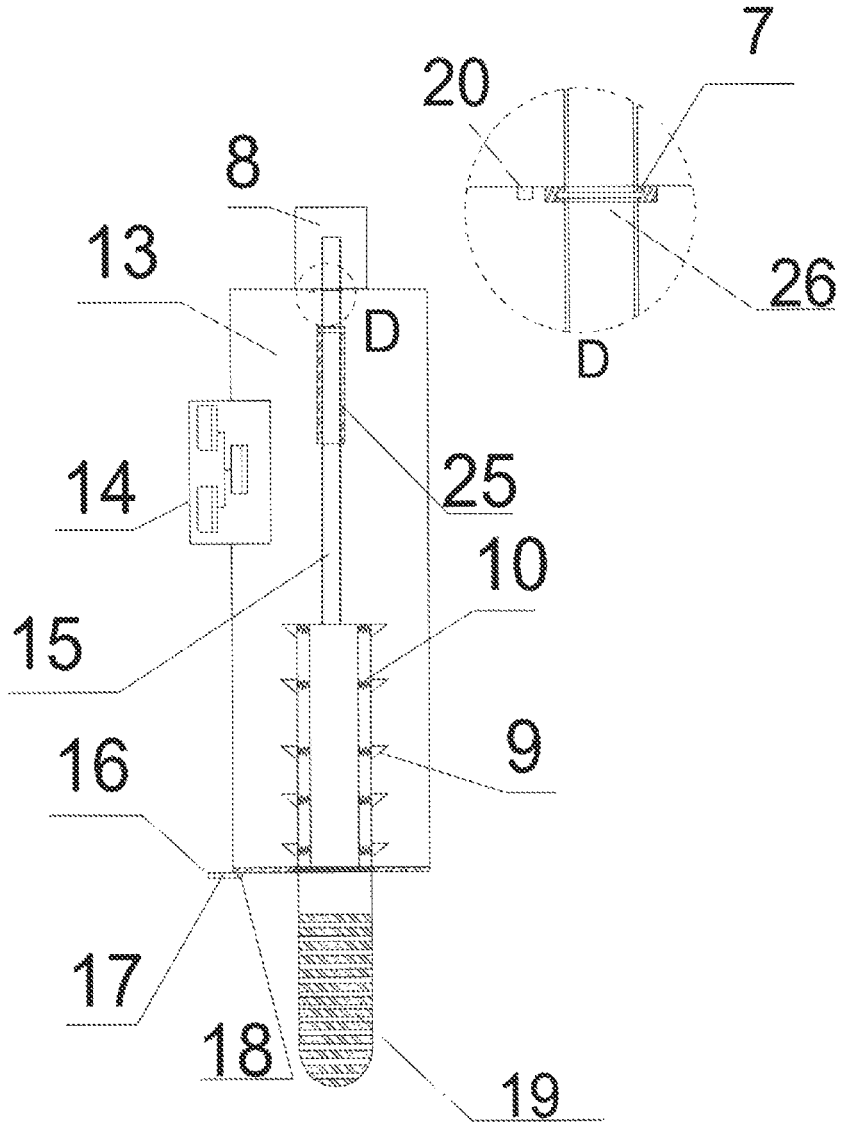
FIG. 5 shows the structure of the pump front chamber automatic compensation device and a partial enlargement at the motor.
Figure 6:
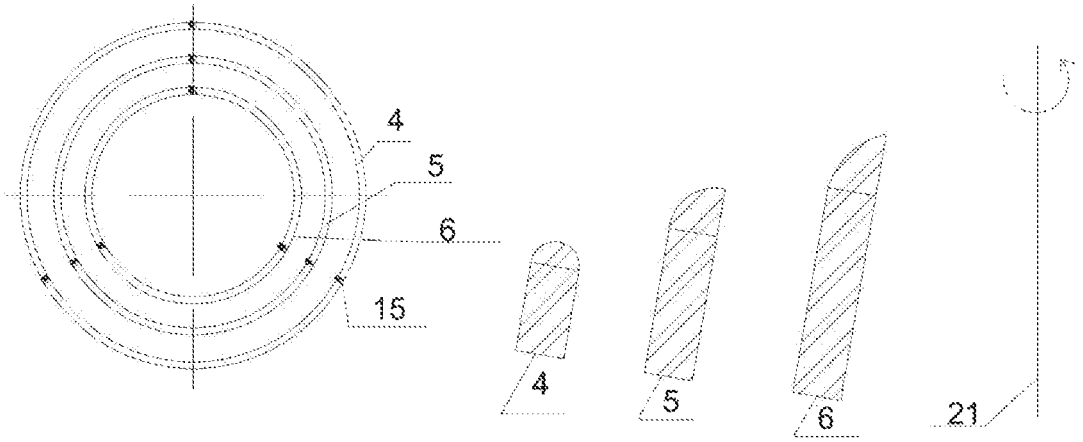
FIG. 6 shows a schematic diagram of the spacer axial for the pump front chamber automatic compensation device.

Specifically, as in FIGS. 2 and 6, the spacer is a circular body with the pump shaft as the center of rotation and the thickness of the spacer profile rectangle is 5 mm. In combination with FIG. 1, the spacer's right end (top) extends to the impeller's front cover. To prevent the inflow of media into the pump, a waterproof ring 11 and guide ring 12 are provided at the contact between the spacer and the hydraulic chamber 13, as in FIG. 4, from right to left, the spacer rounded tip section 23, the spacer rectangular section 24 and the automatic compensation assembly 27; both the spacer rounded tip section 23 and the spacer rectangular section 24 are made of Material HT200, with a nickel-chromium alloy plating on the outer surface of the spacer; as in FIG. 3, the removable connection between the spacer circular tip section 23 and the spacer rectangular section 24 is achieved through a pin 22. Pin 22 has three pins, pin 22 has a diameter of 2 mm, pin 22 hole is located on the side of the spacer away from the impeller outlet, the pinhole is 8 mm-15 min from the top of the rounded tip of the spacer. Since the circular tip section 23 is subjected to the impact and wear of the impeller outlet media, it is designed to be removable for easy replacement of the worn circular tip section 23.

The automatic compensation assembly 27 comprises an inner shaft 28, which is fixedly connected to the left end of the spacer rectangular section 24. The other end is fixedly connected to the right end of the push rod 15, the left end of the push rod 15 is threaded to the right end of the threaded shaft 25, the left end of the threaded shall 25 is fixed to the output end of the motor shaft 26, and when the motor shaft 26 rotates, the threaded shaft 25 causes the push rod 15 to move linearly. The overall length of the threaded shaft 25 is ⅓ to ½ the length of the push rod 15. The motor shaft 26 is the dynamic shaft of the micro-motor 8, the micro-motor 8 is fixed to the outer wall of the pump body, the micro-motor 8 is connected to the hydraulic chamber 13 with a dust ring such as in g. 5. Inner shaft 28 outer parallel set sleeve 29, the outer diameter of the sleeve 29 being the same as that of the spacer rectangular section 24, and the inner shall 28 is provided with a telescopic positioner, the telescopic positioner is telescopic in the radial direction between the inner shaft 28 and the sleeve 29; in this embodiment, the telescopic positioner is provided with a plurality of triangular blocks 9 evenly spaced along the axial direction on the outside of the inner shall 28, the triangular blocks 9 is a right-angled triangular block, the right-angled edge of the bottom of triangular block 9 is fixed to the surface of inner shaft 28 by means of spring 10, the beveled edge of triangular block 9 is design oriented towards the front chamber of the pump, the sleeve 29 is provided with a hole for fitting a triangular block 9, which under normal conditions, the triangular block 9 is exposed from the sleeve 29 and is squeezed into the sleeve 29 when an external force is applied inwards, using the triangular block 9 to secure the spacer can only be fed in the direction of impeller 3, similar to the action of an ordinary check valve; due to the high pressure in the pump front chamber clearance 2, the spacer can be fixed without retreating towards the wall of pump body 1. In this embodiment, the spacing between adjacent compressible triangular blocks 9 is kept at 3 to 5 mm.

The automatic compensation assembly 27 is housed in the hydraulic chamber 13, the hydraulic chamber 13 is embedded in the inner wall of the front chamber of the pump.

Since the front chamber of the pump body and the front cover of the impeller are both streamlined, to better stop part of the high-speed fluid flowing out of the impeller outlet from flowing back into the front chamber along the direction of the front chamber wall, multiple layers of spacers can be set up, in this example three layers are set up, along the direction of fluid flow, namely the third layer of spacer 6, the second layer of spacer 5 and the first layer of spacer 4; as the first layer of spacer 4 is closest to the impeller outlet, the greater the impact of the medium on the first layer of spacer 4, the radius of the arc at the tip of the circular tip section 23 of the first layer is ½ of the width of the rectangle of the partition profile; the tip of the latter layer is less impacted due to the decrease of the return flow velocity, so the radius of the tip is increased to stop the impact of the fluid to the next layer as much as possible. The radius of the tip arc of the third layer of spacer 6 and the second layer of spacer 5 is therefore ⅔ of the spacer's profile rectangle width. The radius of the tip arc of the third layer of spacer is ¾ of the spacer's profile rectangle width, with the center of the tip arc of the last two spacers located on the long side away from the impeller outlet.

$Z_i$ (i=1.2.3) is the distance from the pump body wall normal to the front cover of the impeller at the front chamber spacer, the impeller radius is R, the horizontal line (parallel to the pump shaft) is made at the outlet of the front cover of the impeller, using this horizontal line as a reference, the length of the vertical line down to the contact point between the center of the partition section and the wall of the pump chamber, the distance from the point of projection of the first partition to the horizontal line is $L_1$ 1/30R~1/25R, the distance from the projection point of the second partition to the horizontal line is $L_2$=1/5R~1/4R, the distance from the projection point of the third partition to the horizontal line is $L_3$=1/3~1/2R. The length of the first spacer sticking out of the wall of the pump body is $3/10Z_1$~$2/5Z_1$ mm the length of the second spacer sticking out of the wall of the pump body is $2/5Z_2$~$3/5Z_2$ mm, the length of the third spacer sticking out of the wall of the pump body is $1/2Z_3$~$7/10Z_3$ mm. The spacer, which does not protrude from the internal wall of the pump, is placed in the hydraulic chamber to compensate for protruding part of the spacer.

The compensation feedback device comprises a compensation detection assembly and a compensation control assembly, the compensation detection assembly comprising a distance signal transmitter 16, a light-sensing distance sensor 17, a halogen lamp 18 and a reflective ribbon 19, the reflective ribbon 19 being provided at the circular tip section of the spacer 23, the most reflective white color for the ribbon; the width of reflective ribbon 19 is $1/15Z_i$ and the reflective ribbon 19 are spaced equally between each other and are spaced at $1/25Z_i$. The distance signal transmitter 16, the light-sensing distance sensor 17 and the halogen lamp 18 are integrated and fixed to the outer wall of the hydraulic chamber 13 where the spacer protrudes, and the halogen lamp 18 for emitting light and making the ribbon reflective; the light-sensitive distance sensor 17 detects the reflection of the outermost ribbon to obtain the vertical distance between the outermost end of the spacer and the pump wall at this point (i.e. the length of the spacer protruding at this point); the light-sensing distance sensor 17 is connected by a signal to distance signal transmitter 16, the distance signal transmitter 16 receives the distance information detected by the light-sensing distance sensor 17 and transmits it to the compensation control assembly. The compensation control assembly includes a state machine 14 and a distance signal receiver 20, the distance signal receiver 20 is fixedly mounted in the hydraulic chamber 13 near the motor shaft 26, the state machine 14 is set in the hydraulic chamber 13, and the state machine 14 is connected to the distance signal receiver 20 and the distance signal transmitter 16 respectively by signal lines for the transmission of signals; the distance signal receiver 20 is connected to the micro-motor 8, and the control output of the state machine 14 is fed to the micro-motor 8 and the operation of the micro-motor 8 is controlled.

The principle of operation of the compensation feed-back device is as follows: The top of the spacer is subjected to hydraulic impact at the impeller outlet and media corrosion so that the top of the spacer is subject to wear and tear, making the gap between it and the front cover of the impeller larger and therefore requiring automatic compensation of the spacer; at this time, the halogen lamp 18 works to irradiate the reflective ribbon 19, and the light-sensitive distance sensor 17 scans the farthest ribbon and records the distance, thus converting the ribbon to the vertical distance M from the pump wall based on the internal function of the light-sensitive distance sensor 17, which is mainly calculated based on the angle and the distance of the farthest ribbon from the scan. The distance information calculated by the light-sensitive distance sensor 17 is sent to the state machine 14 through the distance signal transmitter 16. The state machine 14 identifies the distance signal through internal logic statements. It calculates the distance N=K−M that the spacer needs to be fed, where K is the initial distance of the spacer out of the pump wall and Ni is the actual distance of the spacer out of the pump wall as detected by the light-sensitive distance sensor 17. The logic of the state machine 14 is as follows: the feedback distance M of the light-sensitive distance sensor 17 is compared with the set distance K of the initial protrusion of the partition from the wall, and if equal, no distance information is passed to the distance signal receiver 20. If it is less than, the difference N is transmitted to the micro-motor 8, which is used to actuate the distance N received by pushing the spacer through the push rod 15. The micro-motor 8 is fixed to the outer wall of the pump body to ensure the position of the threaded shaft 25 connected to the motor shaft 26, and the motor shaft rotates the threaded shaft using the threads at the end of the push rod 15 for propulsion. The initial design distance of the spacer is always maintained through real-time monitoring by the compensation feed-back device K, thus ensuring maximum efficiency operation at all times.

The above examples are only used to illustrate the design ideas and features of the present invention are intended to enable a person skilled in the art to understand the content of the present invention and implement it accordingly. Therefore, any equivalent changes or modifications based on the principles and design ideas revealed by the present invention are within the scope of protection.

What is claimed is:

1. A pump front chamber automatic compensation device for inhibiting occurrence of closed impeller backflow, wherein the automatic compensation device is fixedly mounted on an inner wall surface of a pump body front chamber and extends from the inner wall surface of the pump body front chamber to a front cover plate of an impeller to stop a flow of fluid from the impeller outlet to a pump front chamber; wherein the automatic compensation device comprises a spacer and a compensation feedback device; a first end of the spacer extends into the pump front chamber, and a second end of the spacer is connected to an automatic compensation assembly wherein an extension length of the spacer is automatically compensated by the automatic compensation assembly; the compensation feedback device controls the automatic compensation assembly;

wherein the automatic compensation assembly comprises an inner shaft; a first end of the inner shaft is connected in turn to a push rod, a threaded shaft and a motor shaft, and a second end of the inner shaft is fixedly connected to a rectangular section of the spacer; the automatic compensation assembly is provided in a hydraulic chamber.

2. The pump front chamber automatic compensation device for inhibiting occurrence of the closed impeller backflow according to claim 1, wherein the spacer is one of a plurality of spacers that are provided in parallel layers.

3. The pump front chamber automatic compensation device for inhibiting occurrence of the closed impeller backflow according to claim 1, wherein the inner shaft is provided with a sleeve coaxially on an outside thereof, the inner shaft is provided with a telescopic positioner provided with a triangular block and spring, the telescopic positioner telescopes radially between the inner shaft and the sleeve; and extension of the spacer is implemented by the telescopic positioner when the inner shaft extends out of the hydraulic chamber for automatic compensation.

4. The pump front chamber automatic compensation device for inhibiting occurrence of the closed impeller backflow according to claim 3, wherein the spacer is one of a plurality of spacers that are provided in parallel layers.

5. The pump front chamber automatic compensation device for inhibiting occurrence of the closed impeller backflow according to claim 1, wherein the compensation feedback device comprises a compensation detection assembly and a compensation control assembly; the compensation detection assembly comprises a distance signal transmitter-, a light-sensing distance sensor, a halogen lamp and a reflective ribbon; the reflective ribbon is provided at a circular tip section of the spacer; the distance signal transmitter, the light-sensing distance sensor and the halogen lamp are fixed to an outer wall surface of the hydraulic chamber at a protruding part of the spacer.

6. The pump front chamber automatic compensation device for inhibiting occurrence of the closed impeller backflow according to claim 5, wherein the spacer is one of a plurality of spacers that are provided in parallel layers.

7. The pump front chamber automatic compensation device for inhibiting occurrence of the closed impeller backflow according to claim 5, wherein the compensation control assembly comprises a state machine; the state machine is respectively connected to the distance signal transmitter and a micro-motor; wherein a control logic of the state machine is: when a distance value M returned by the light-sensing distance sensor is less than K, then the state machine issues an operating command to the micro-motor to push the push rod by rotating the threaded shaft for compensation with a compensating length (push) distance of $N=K-M$, wherein K is an initial distance of the spacer out of a pump wall and M is an actual distance of the spacer out of the pump wall as detected by the light-sensing distance sensor.

8. The pump front chamber automatic compensation device for inhibiting occurrence of the closed impeller backflow according to claim 7, wherein the spacer is one of a plurality of spacers that are provided in parallel layers.

9. The pump front chamber automatic compensation device for inhibiting occurrence of the closed impeller backflow according to claim 1, wherein the spacer is a circular body, wherein a pump shaft is disposed at a center of the circular body, and wherein the spacer comprises a rectangular section and a circular tip section; the rectangular section of the spacer and the circular tip section of the spacer are removably connected to facilitate a replacement of the circular tip section of the spacer.

10. The pump front chamber automatic compensation device for inhibiting occurrence of the closed impeller backflow according to claim 9, wherein the spacer is one of a plurality of spacers that are provided in parallel layers.

11. The pump front chamber automatic compensation device for inhibiting occurrence of the closed impeller backflow according to claim 9, wherein an outer surface of the spacer is coated with a nickel-chromium alloy.

12. The pump front chamber automatic compensation device for inhibiting occurrence of the closed impeller backflow according to claim 11, wherein the spacer is one of a plurality of spacers that are provided in parallel layers.

* * * * *